US007224126B2

(12) United States Patent
Chiou et al.

(10) Patent No.: US 7,224,126 B2
(45) Date of Patent: May 29, 2007

(54) PULSE WIDTH MODULATION METHOD FOR DRIVING AN OLED PANEL

(75) Inventors: Yu-Wen Chiou, Hsinhua (TW); Cheng-Lung Chiang, Hsinhua (TW)

(73) Assignee: Himax Technologies, Inc. (TW)

( * ) Notice: Subject to any disclaimer, the term of this patent is extended or adjusted under 35 U.S.C. 154(b) by 0 days.

(21) Appl. No.: 11/175,362

(22) Filed: Jul. 7, 2005

(65) Prior Publication Data

US 2007/0008256 A1 Jan. 11, 2007

(51) Int. Cl.
*G09G 3/10* (2006.01)
*G09G 5/10* (2006.01)

(52) U.S. Cl. ..... 315/169.3; 345/691

(58) Field of Classification Search ..... 315/160, 315/161, 169.1, 169.3; 345/690, 691, 694, 345/211, 212, 55, 76, 77, 82
See application file for complete search history.

(56) References Cited

U.S. PATENT DOCUMENTS 5,923,309 A * 7/1999 Ishizuka et al. ..... 345/82
6,771,235 B2 * 8/2004 Ishizuka et al. ..... 345/77
6,914,388 B2 * 7/2005 Shin et al. ..... 315/169.2
2003/0184237 A1 * 10/2003 Togashi et al. ..... 315/169.3
2004/0008165 A1 * 1/2004 Yen-Hua ..... 345/76
2004/0233148 A1 * 11/2004 Tanghe et al. ..... 345/83
2004/0239257 A1 * 12/2004 Yang ..... 315/169.3

* cited by examiner

*Primary Examiner*—Thuy Vinh Tran

(57) ABSTRACT

An organic light emitting display (OLED) panel has a plurality of organic light emitting diodes. The organic light emitting diodes are electrically connected to a plurality of segment lines and a plurality of common lines in a matrix structure. The organic light emitting diodes electrically connected to the same common lines are divided into a first group and a second group. Driving currents are separately supplied to the organic light emitting diodes of the first group and the second group according to a first pulse width modulation (PWM) manner and a second PWM manner. The first PWM manner and the second PWM manner have complementary waveforms in a period.

15 Claims, 7 Drawing Sheets

PULSE WIDTH MODULATION METHOD FOR DRIVING AN OLED PANEL

BACKGROUND

1. Field of Invention

The present invention relates to a method for driving an organic light emitting display (OLED) panel. More particularly, the present invention relates to a pulse width modulation method for driving an OLED panel.

2. Description of Related Art

Flat panel displays are generally classified into inorganic devices and organic devices according to the display materials used in the flat panel displays. The inorganic devices include plasma display panels, field emission displays and the like; the organic devices include liquid crystal displays, organic light emitting displays (OLED) and the like. The OLED is in the spotlight because of its operating speed being faster than that of the liquid crystal display by thirty thousand times. In addition, the OLED has advantages of wide viewing angle and high brightness due to emitting light by itself.

FIG. 1 is a schematic view of a conventional OLED 100. An OLED panel 110 has a plurality of organic light emitting diodes 112, which are driven by a segment driver 120 and a common driver 130 through segment lines 122 and common lines 132. Particularly, the organic light emitting diodes 112 are electrically connected to the segment lines 122 and common lines 132 in a matrix structure. In the prior art, a pulse width modulation (PWM) manner is provided to supply driving currents to the organic light emitting diodes 112. The driving currents of the PWM manner may have different pulse widths. The pulse width determines the intensity of the light emitted from the organic light emitting diode 112.

FIG. 2 is a schematic view of waveforms provided by a conventional PWM manner, in which the waveforms GS1 to GS4 of 2-bit grayscales are illustrated as an example. In a period, the pulse widths of the waveforms GS1 to GS4 are altered in accordance with different grayscales. However, the rising edges of the waveforms corresponding to different grayscales are all positioned at a starting time $t_0$ of the period T. The coherent rising of the waveforms GS1 to GS4 causes a peak current to be generated at the starting time $t_0$ of the period T. The peak current increases the required Vcc of the segment driver 120 (as illustrated in FIG. 1), and the power consumption of the OLED 100 is thus raised.

FIG. 3 is a schematic view of waveforms provided by another conventional PWM manner, in which the waveforms GS1 to GS4 of 2-bit grayscales are illustrated as an example. In this PWM manner, the rising edges of the waveforms GS1 to GS4 corresponding to different grayscales are changed from the starting time $t_0$ to other times (e.g. $t_1$ and $t_3$) of the period T. The peak current caused by the coherent rising of different grayscale waveforms GS1 to GS4 is therefore decreased. Nevertheless, if the organic light emitting diodes 112 electrically connected to the same common line 132 (as illustrated in FIG. 1) are simultaneously represented by the same grayscale, the driving currents having the same waveform are supplied at the same time. Consequently, the peak current issue still remains.

SUMMARY

It is therefore an aspect of the present invention to provide a method for driving an OLED panel that mitigates the peak current issue.

According to one preferred embodiment of the present invention, the OLED panel includes a plurality of organic light emitting diodes. The organic light emitting diodes are electrically connected to a plurality of segment lines and a plurality of common lines in a matrix structure.

The organic light emitting diodes electrically connected to the same common lines are divided into a first group and a second group. Driving currents are separately supplied to the organic light emitting diodes of the first group and the second group according to a first pulse width modulation (PWM) manner and a second PWM manner. The first PWM manner and the second PWM manner have complementary waveforms in a period.

According to another preferred embodiment of the present invention, the OLED panel includes a plurality of organic light emitting diodes. Driving currents are supplied to a first group of the organic light emitting diodes electrically connected to a common line according to a first pulse width modulation (PWM) manner. Driving currents are supplied to a second group of the organic light emitting diodes electrically connected to the common line according to a second PWM manner. The first PWM manner and the second PWM manner have complementary waveforms in a period.

It is another aspect of the present invention to provide an OLED, of which the Vcc of its segment driver is decreased and the power consumption is thus lowered.

According to one preferred embodiment of the present invention, the OLED comprises a plurality of segment lines, a plurality of common lines, a plurality of organic light emitting diodes and a segment driver. The organic light emitting diodes are electrically connected to the segment lines and the common lines in a matrix structure. The organic light emitting diodes of one common line are divided into a first group and a second group. The segment driver is electrically connected to the segment lines and supplies driving currents to the organic light emitting diodes of the first group and the second group separately according to a first pulse width modulation (PWM) manner and a second PWM manner. The first PWM manner and the second PWM manner have complementary waveforms in a period.

In conclusion, the invention can effectively decrease the peak current usually occurring in the conventional PWM manner for driving the OLED panel and further decrease the Vcc of the segment driver, so as to lower the power consumption of the OLED.

It is to be understood that both the foregoing general description and the following detailed description are examples and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings, where:

DESCRIPTION OF THE PREFERRED EMBODIMENTS

Figure 1:
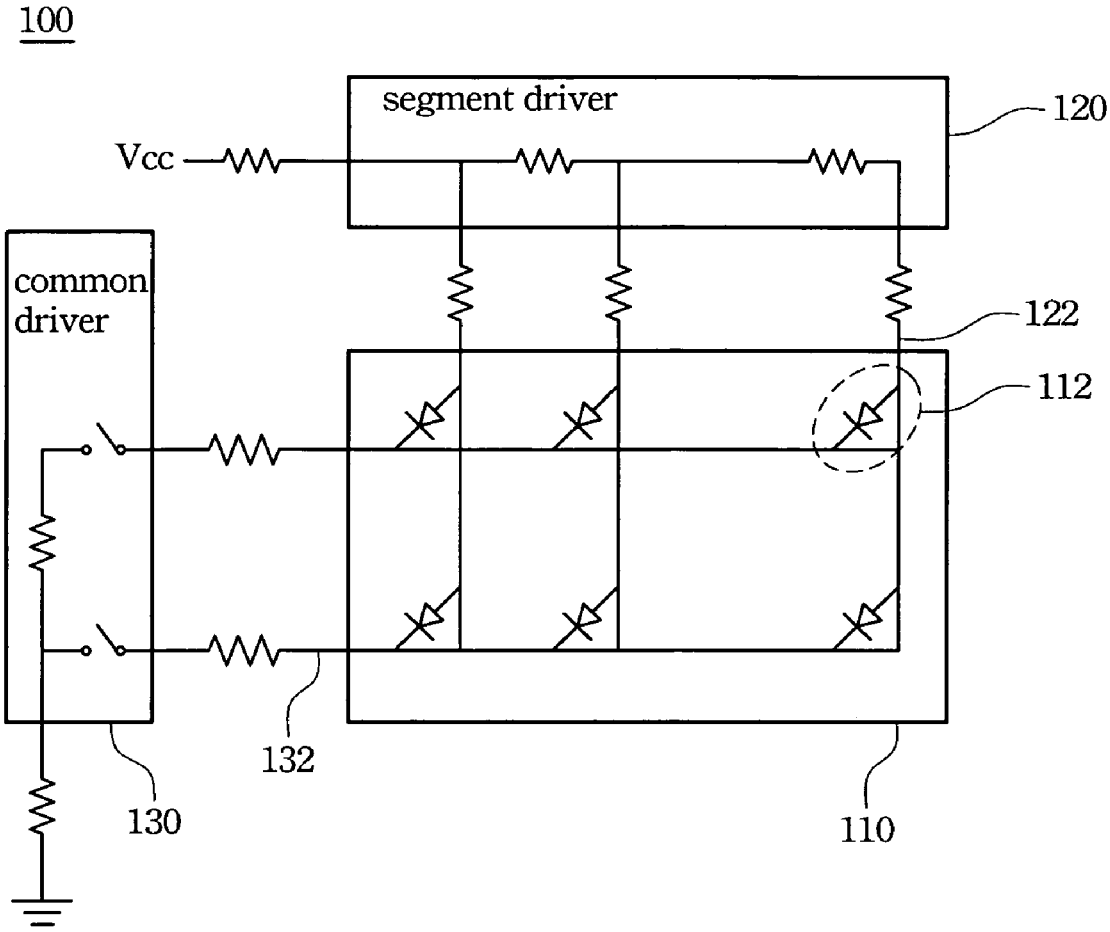
Fig. 1 (PRIOR ART)
FIG. 1 is a schematic view of a conventional OLED.
Figure 2:
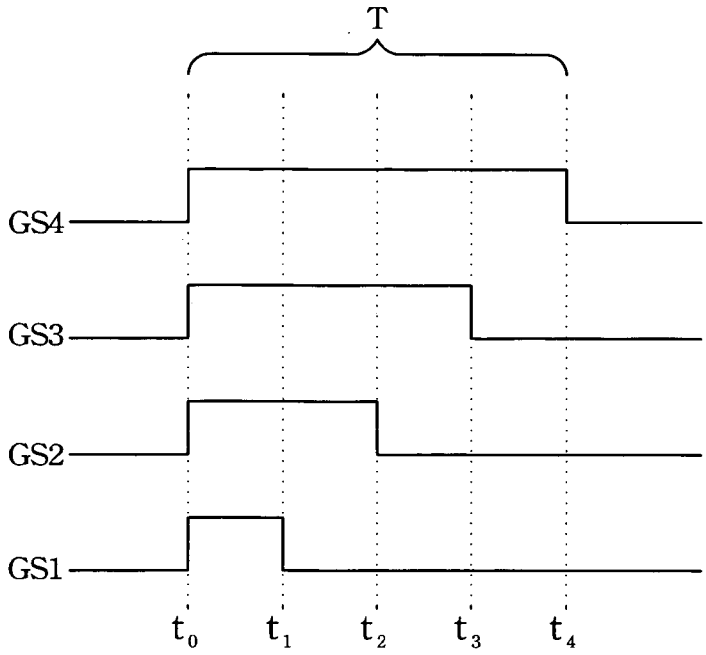
Fig. 2 (PRIOR ART)
FIG. 2 is a schematic view of waveforms provided by a conventional PWM manner.
Figure 3:
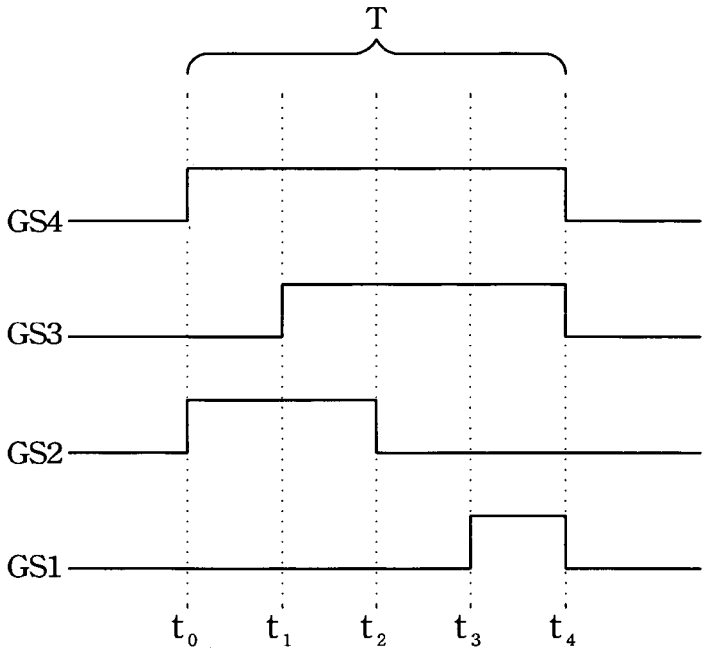
Fig. 3 (PRIOR ART)
FIG. 3 is a schematic view of waveforms provided by another conventional PWM manner.

Reference will now be made in detail to the present preferred embodiments of the invention, examples of which are illustrated in the accompanying drawings. Wherever possible, the same reference numbers are used in the drawings and the description to refer to the same or like parts.

The present invention divides the organic light emitting diodes of the same common line into two groups and drives the organic light emitting diodes of the two groups according to different PWM manners, which have complementary waveforms in a period.

Generally, an OLED panel includes a plurality of organic light emitting diodes. The organic light emitting diodes are electrically connected to a plurality of segment lines and a plurality of common lines in a matrix structure.

Figure 4:
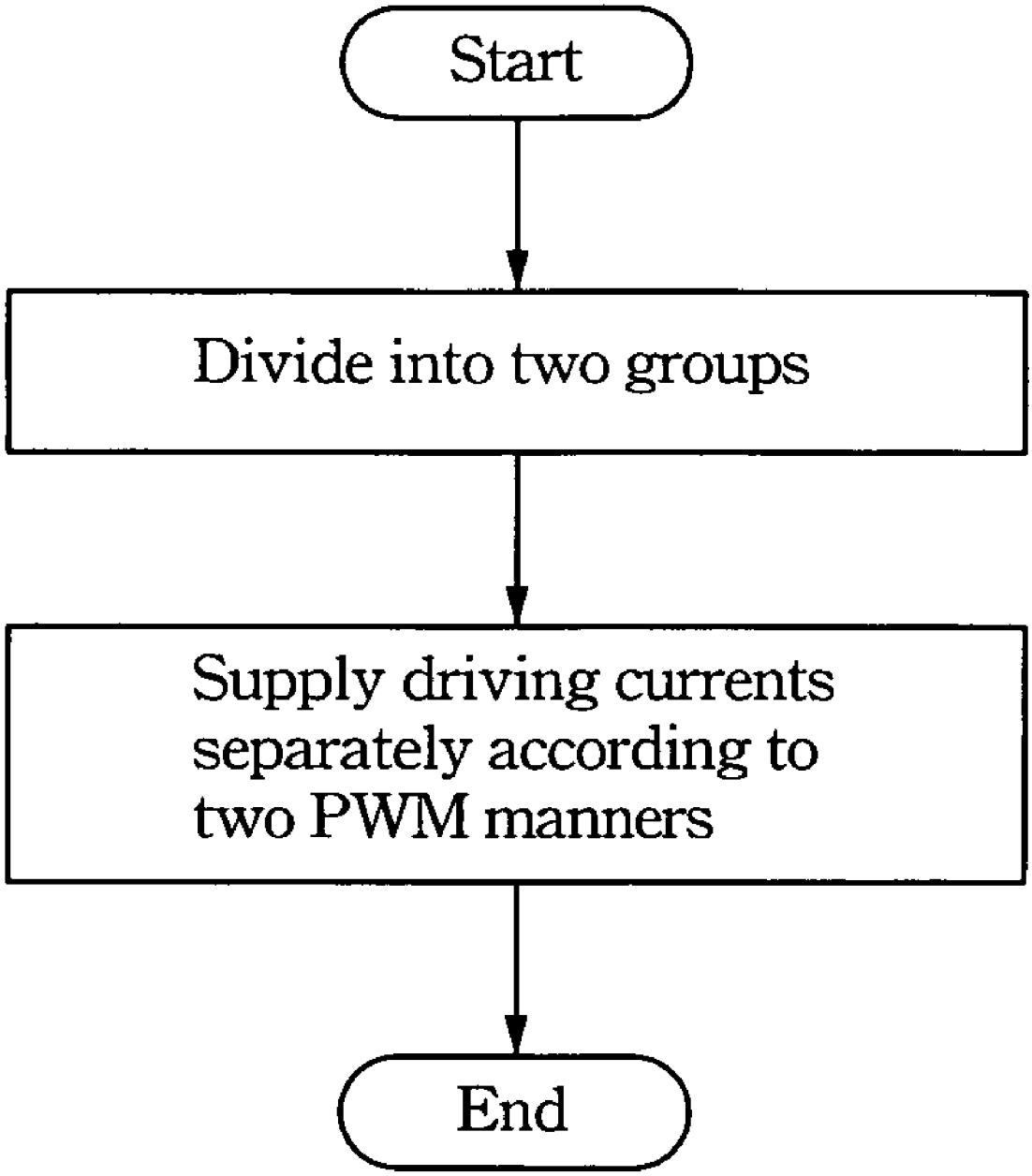
FIG. 4 is a flow chart of one preferred embodiment of the present invention.

FIG. 4 is a flow chart of one preferred embodiment of the present invention. The organic light emitting diodes electrically connected to the same common lines are divided into a first group and a second group (step 402). Driving currents are separately supplied to the organic light emitting diodes of the first group and the second group according to a first pulse width modulation (PWM) manner and a second PWM manner. The first PWM manner and the second PWM manner have complementary waveforms in a period (step 404).

Driving currents are supplied to a first group of the organic light emitting diodes electrically connected to a common line according to a first pulse width modulation (PWM) manner. Driving currents are supplied to a second group of the organic light emitting diodes electrically connected to the common line according to a second PWM manner. The second PWM manner is complementary to the first PWM manner with respect to its waveform in a period.

Figure 5A:
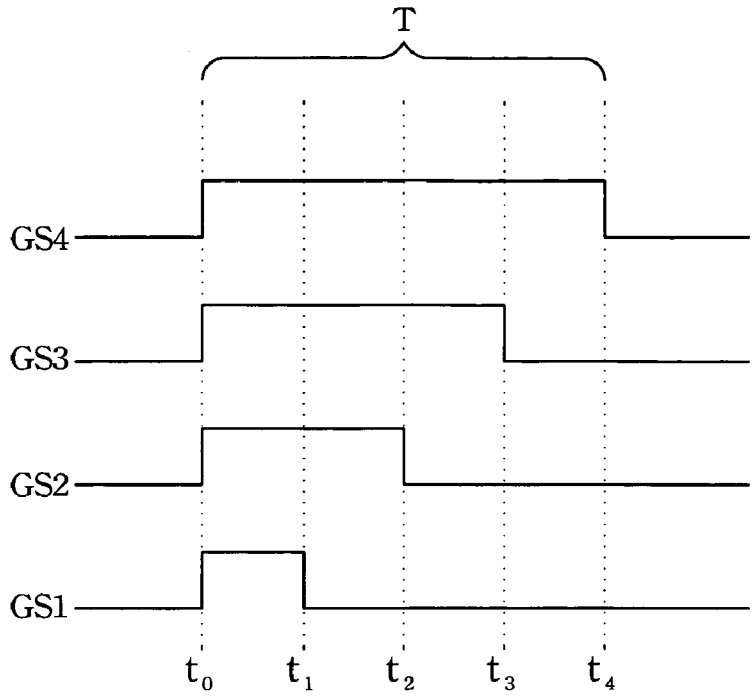
FIG. 5A is a schematic view of waveforms provided by the first PWM manner of one preferred embodiment.
Figure 5B:
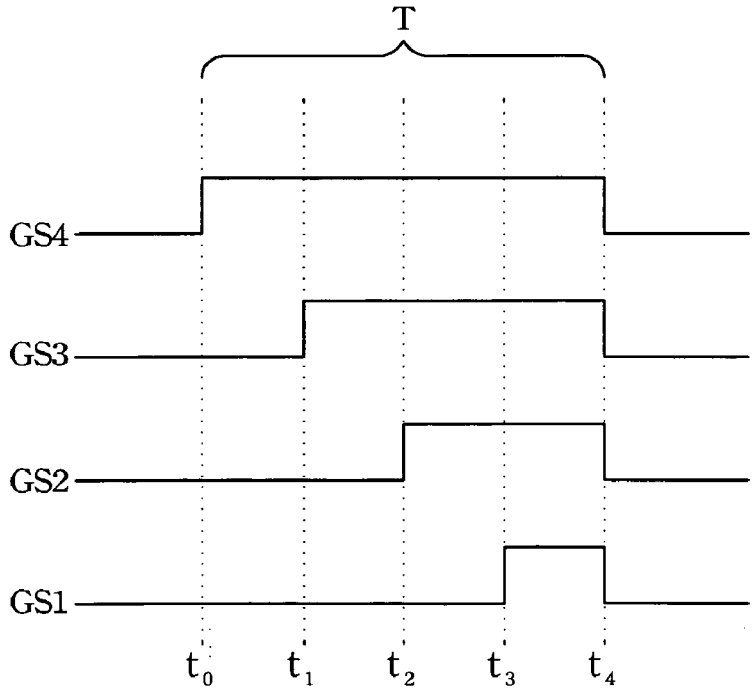
FIG. 5B is a schematic view of waveforms provided by the second PWM manner of one preferred embodiment.

FIG. 5A is a schematic view of waveforms provided by the first PWM manner of one preferred embodiment, and FIG. 5B is a schematic view of waveforms provided by the second PWM manner of one preferred embodiment. FIG. 5A and FIG. 5B use the waveforms GS1 to GS4 of 2-bit grayscales as an example to illustrate that the first and the second PWM manners have complementary waveforms in the period T. In FIG. 5A, the rising edges of the waveforms GS1 to GS4 corresponding to different grayscales are all positioned at a starting time $t_0$ of the period T. In FIG. 5B, the falling edges of the waveforms GS1 to GS4 corresponding to different grayscales are all positioned at an ending time $t_4$ of the period T.

More particularly, from the lowest grayscale (e.g. GS1) to the highest grayscale (e.g. GS4), the waveforms GS1 to GS4 of the first PWM manner are increased in length by measuring from the starting time $t_0$ of the period T, and the waveforms GS1 to GS4 of the second PWM manner are increased in length by measuring from the ending time $t_4$ of the period T. As illustrated in FIG. 5A and FIG. 5B, the waveforms of the same grayscale are temporarily complementary, and therefore the peak current occurring for the organic light emitting diodes with the same grayscale is effectively decreased.

In other words, except for the highest grayscale (e.g. GS4), the waveforms representing the same grayscale of the first PWM manner and the second PWM manner can fall at different times in the period T. Alternatively, except for the highest grayscale (e.g. GS4), the waveforms representing the same grayscale of the first PWM manner and the second PWM manner can rise at different times in the period T.

Furthermore, the period T preferably is a refresh period of the OLED panel. In the OLED panel, the organic light emitting diodes electrically connected to one half of the segment lines are defined as the first group, and the organic light emitting diodes electrically connected to the other half of the segment lines are defined as the second group.

In order to further simplify the panel design, the first group can include the organic light emitting diodes located on one half portion (e.g. the left half portion) of the OLED panel, and the second group can include the organic light emitting diodes located on the other half portion (e.g. the right half portion) of the OLED panel. Alternatively, the segment lines, to which the organic light emitting diodes are electrically connected, can be configured randomly or in an interlaced fashion with respect to the group to which they belong. The interlaced configuration provides segment lines as columns of the panel, where the diodes connected to the segment lines are divided into two groups, such as on segment lines 1, 3, 5 and 7 in the first group and on segment lines 2, 4, 6 and 8 in the second group.

However, the waveforms of the first PWM manner are not limited to rise at the starting time of the period T, and the waveforms of the first PWM manner are to not limited to fall at the ending time of the period T. Persons skilled in the art should understand that the waveforms of the first and the second PWM manners, which represent the same grayscale, might be discrete, or might rise or fall at other times of the period T as long as the waveforms of the two manners are complementary to decrease the peak current.

Furthermore, more than two PWM manners can be applied to one OLED panel for driving its organic light emitting diodes. That is, the organic light emitting diodes on the OLED panel can be defined as more than two groups, and the segment lines to which the organic light emitting diodes electrically connected can be configured randomly, or in different portions of the OLED panel, or in an interlaced fashion with respect to the group to which they belong.

The followings provide two examples for interpreting how to apply more than two PWM manners (e.g. three PWM manners) to one OLED panel. One of the examples is illustrated in FIGS. 6A to 6C and the other is illustrated FIGS. 7A to 7C, and both of them apply three PWM manners.

Figure 6A:
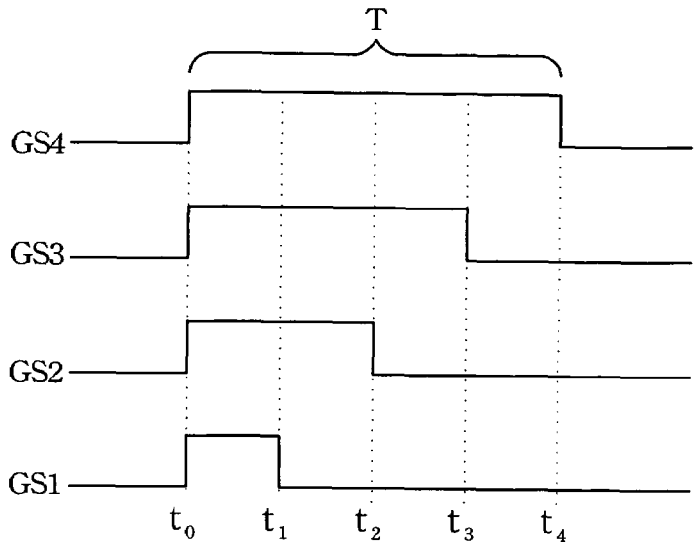
FIGS. 6A, 6B and 6C are schematic views of waveforms respectively provided by the first, second and third PWM manner of one preferred embodiment.
Figure 6B:
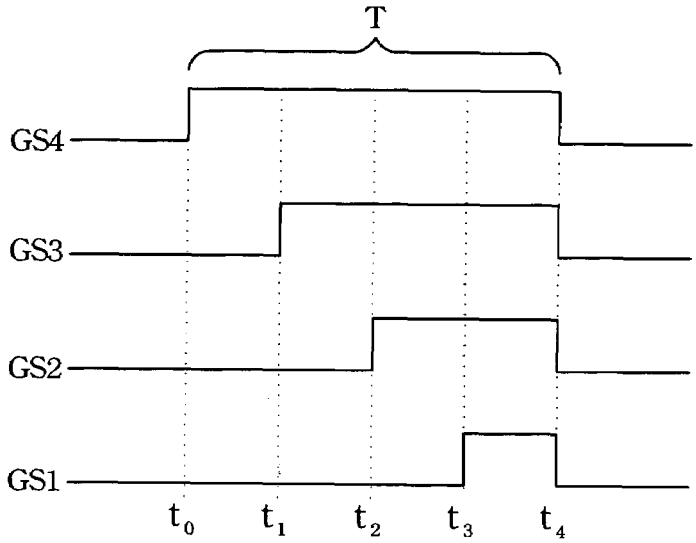
Figure 6C:
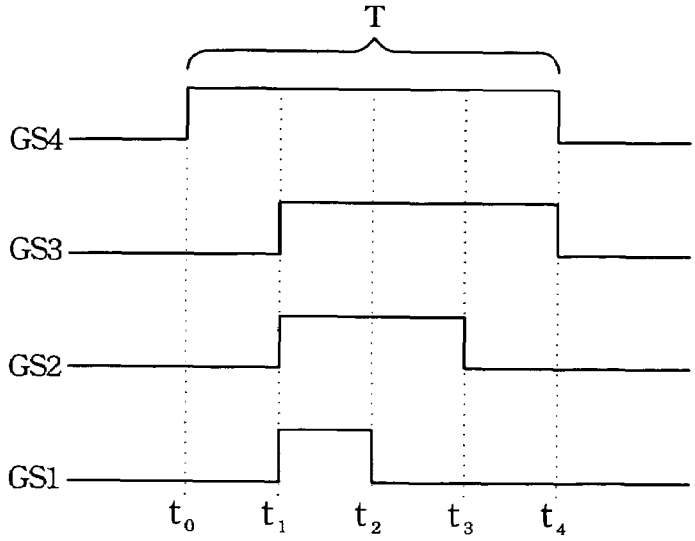

In the first example, FIGS. 6A, 6B and 6C are schematic views of waveforms provided by the first, second and third PWM manner, respectively. FIGS. 6A, 6B and 6C use the waveforms GS1 to GS4 of 2-bit grayscales as an example to illustrate that the first, second and third PWM manners have complementary waveforms in the period T.

In FIG. 6A, the rising edges of the waveforms GS1 to GS4 corresponding to different grayscales are all positioned at a starting time $t_0$ of the period T. In FIG. 6B, the falling edges of the waveforms GS1 to GS4 corresponding to different grayscales are all positioned at an ending time $t_4$ of the period T. In FIG. 6C, the rising edges of the waveforms GS1 to GS3 corresponding to different grayscales are positioned at time $t_1$ of the period T, and the falling edges of the waveforms GS1 to GS4 are positioned at times $t_2$, $t_3$, $t_4$ and $t_4$, respectively.

Figure 7A:
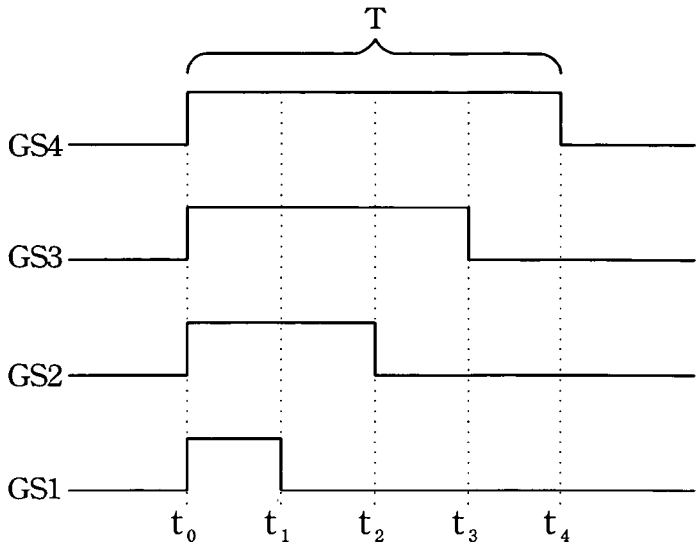
FIGS. 7A, 7B and 7C are schematic views of waveforms respectively provided by the first, second and third PWM manner of another preferred embodiment.
Figure 7B:
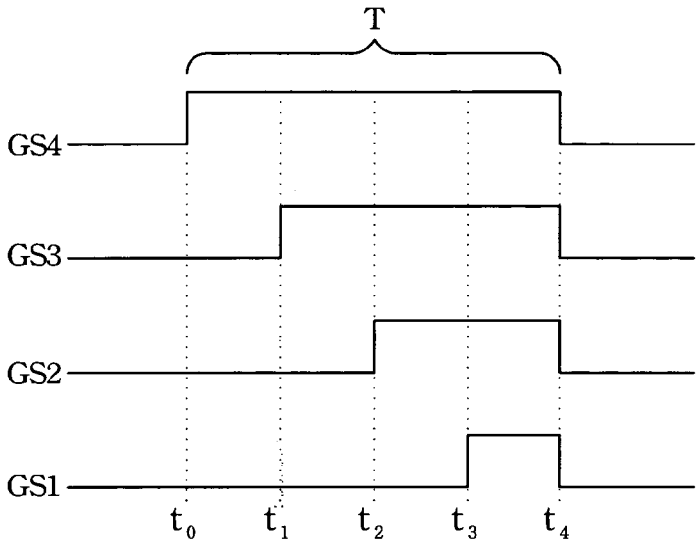
Figure 7C:
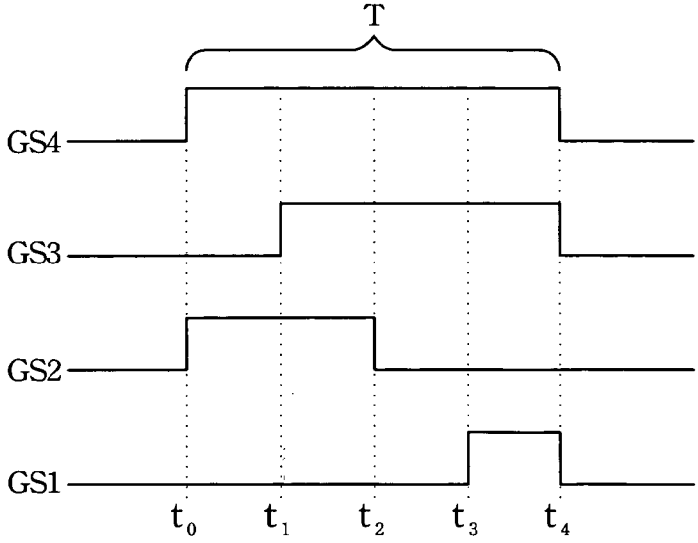

In the second example, FIGS. 7A, 7B and 7C are schematic views of waveforms provided by the first, second and third PWM manner, respectively. FIGS. 7A, 7B and 7C use the waveforms GS1 to GS4 of 2-bit grayscales as an example to illustrate that the first, second and third PWM manners have complementary waveforms in the period T.

In FIG. 7A, the rising edges of the waveforms GS1 to GS4 corresponding to different grayscales are all positioned at a starting time $t_0$ of the period T. In FIG. 6B, the falling edges of the waveforms GS1 to GS4 corresponding to different grayscales are all positioned at an ending time $t_4$ of the period T. In FIG. 6C, the rising edges of the waveforms GS1 to GS4 corresponding to different grayscales are respectively positioned at time $t_3$, $t_0$, $t_1$ and $t_0$ of the period T, and the falling edges of the waveforms GS1 to GS4 are positioned at times $t_4$, $t_2$, $t_4$ and $t_4$.

In other words, except for the highest grayscale (e.g. GS4), the waveforms representing the same grayscale of these PWM manners can be designed to rise or fall at different times in the period T for achieving complementarity. As illustrated in FIGS. 6A, 6B and 6C and FIGS. 7A, 7B and 7C, the waveforms of the same grayscale of each example are temporarily complementary, and therefore the peak current occurring for the organic light emitting diodes with the same grayscale is effectively decreased.

For instance, in the OLED panel, the organic light emitting diodes electrically connected to one third of the segment lines are defined as the first group, the organic light emitting diodes electrically connected to another one third of the segment lines are defined as the second group, and the organic light emitting diodes electrically connected to the rest of the segment lines are defined as the third group.

In order to further simplify the panel design, the first group can include the organic light emitting diodes located on one-third portion (e.g. the left portion) of the OLED panel, the second group can include the organic light emitting diodes located on another one-third portion (e.g. the middle portion) of the OLED panel, and the third group can include the organic light emitting diodes located on the rest portion (e.g. the right portion) of the OLED panel.

Alternatively, the segment lines, to which the organic light emitting diodes are electrically connected, can be configured randomly or in an interlaced fashion with respect to the group to which they belong. The interlaced configuration provides segment lines as columns of the panel, where the diodes connected to the segment lines are divided into third groups, such as on segment lines 1, 4, 7 and 10 in the first group, on segment lines 2, 5, 8 and 11 in the second group and segment lines 3, 6, 9 and 12 in the third group.

Figure 8:
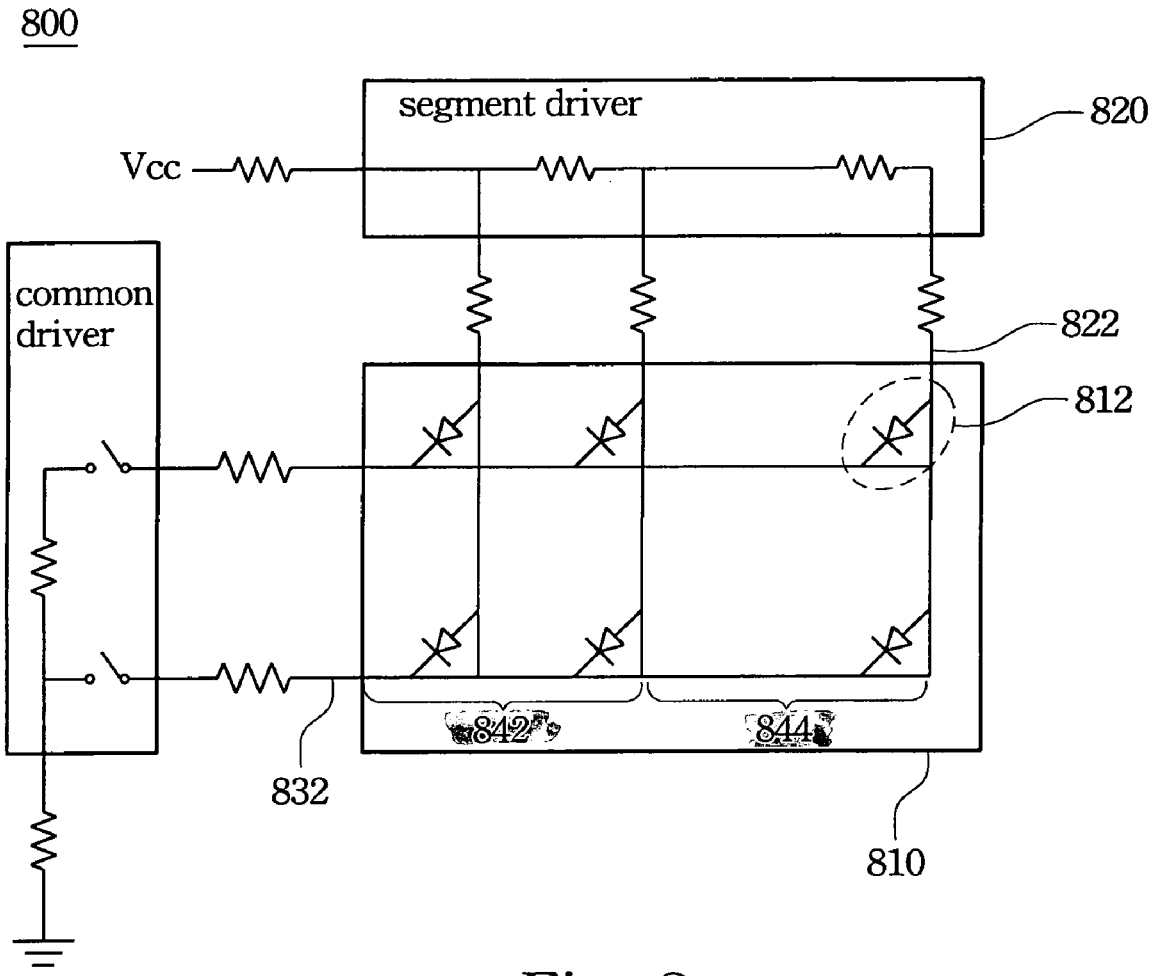
FIG. 8 is a schematic view of an organic light emitting display of one preferred embodiment of the present invention.

FIG. 8 is a schematic view of an organic light emitting display of one preferred embodiment of the present invention. An OLED 800 comprises a plurality of segment lines 822, a plurality of common lines 832, a plurality of organic light emitting diodes 812 and a segment driver 820. The organic light emitting diodes 812 are positioned on an OLED panel 810 and are electrically connected to the segment lines 822 and the common lines 832 in a matrix structure.

The organic light emitting diodes 812 of one common line 832 are divided into a first group 842 and a second group 844. The segment driver 820 is electrically connected to the segment lines 822 and supplies driving currents to the organic light emitting diodes 812 of the first group 842 and the second group 844 separately according to a first pulse width modulation (PWM) manner and a second PWM manner. The first PWM manner and the second PWM manner have complementary waveforms in a period.

Referring to one preferred embodiment of the present invention as illustrated in FIG. 5A and FIG. 5B, in the first PWM manner, the rising edges of the waveforms GS1 to GS4 corresponding to different grayscales are all positioned at a starting time $t_0$ of the period T. In the second PWM manner, the falling edges of the waveforms GS1 to GS4 corresponding to different grayscales are all positioned at an ending time $t_4$ of the period T.

More particularly, from the lowest grayscale (e.g. GS1) to the highest grayscale (e.g. GS4), the waveforms GS1 to GS4 of the first PWM manner are increased in length by measuring from the starting time $t_0$ of the period T, and the waveforms GS1 to GS4 of the second PWM manner are increased in length by measuring from the ending time $t_4$ of the period T. That is, the waveforms of the same grayscale are temporarily complementary, and therefore the peak current occurring for the organic light emitting diodes 812 with the same grayscale is effectively decreased.

In other words, except for the highest grayscale (e.g. GS4), the waveforms representing the same grayscale of the first PWM manner and the second PWM manner can fall at different times in the period T. Alternatively, except for the highest grayscale (e.g. GS4), the waveforms representing the same grayscale of the first PWM manner and the second PWM manner can rise at different times in the period T.

Furthermore, the period T preferably is a refresh period of the OLED panel 810. In the OLED panel 810, the organic light emitting diodes 812 electrically connected to one half of the segment lines 822 are defined as the first group 842, and the organic light emitting diodes 812 electrically connected to the other half of the segment lines 822 are defined as the second group 844.

In order to further simplify the panel design, the first group 842 can include the organic light emitting diodes 812 located on one half portion (e.g. the left half portion) of the OLED panel 810, and the second group 844 can include the organic light emitting diodes 812 located on the other half portion (e.g. the right half portion) of the OLED panel 810. Alternatively, the segment lines 822 can be configured randomly or in an interlaced fashion with respect to the group to which they belong.

In conclusion, the preferred embodiments can effectively decrease the peak current usually occurring in the conventional PWM manner of the OLED panel and further decrease the Vcc of the segment driver, so as to lower the power consumption of the OLED panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for driving an organic light emitting display (OLED) panel including a plurality of organic light emitting diodes, wherein the organic light emitting diodes are electrically connected to a plurality of segment lines and a plurality of common lines in a matrix structure, the method comprising:

dividing the organic light emitting diodes electrically connected to the same common lines into a first group and a second group; and supplying driving currents to the organic light emitting diodes of the first group and the second group separately according to a first pulse width modulation (PWM) manner and a second PWM manner, wherein the first PWM manner and the second PWM manner have complementary waveforms in a period, and from a lowest grayscale to a highest grayscale, the waveforms of the first PWM manner are increased in length by measuring from a starting time of the period, and the waveforms of the second PWM manner are increased in length by measuring from an ending time of the period.

2. The method of claim 1, wherein except for a highest grayscale, the waveforms representing the same grayscale of the first PWM manner and the second PWM manner rise at different times in the period.

3. The method of claim 1, wherein except for a highest grayscale, the waveforms representing the same grayscale of the first PWM manner and the second PWM manner fall at different times in the period.

4. The method of claim 1, wherein the organic light emitting diodes electrically connected to one half of the segment lines are defined as the first group, and the organic light emitting diodes electrically connected to the other half of the segment lines are defined as the second group.

5. The method of claim 1, wherein the period is a refresh period of the OLED panel.

6. A method for driving an organic light emitting display (OLED) panel including a plurality of organic light emitting diodes, the method comprising:

supplying driving currents to a first group of the organic light emitting diodes electrically connected to a common line according to a first pulse width modulation (PWM) manner; and supplying driving currents to a second group of the organic light emitting diodes electrically connected to the common line according to a second PWM manner, wherein the first PWM manner and the second PWM manner have complementary waveforms in a period, and except for a highest grayscale, the waveforms representing the same grayscale of the first PWM manner and the second PWM manner rise at different times in the period.

7. The method of claim 6, wherein from a lowest grayscale to a highest grayscale, the waveforms of the first PWM manner are increased in length by measuring from a starting time of the period, and the waveforms of the second PWM manner are increased in length by measuring from an ending time of the period.

8. The method of claim 6, wherein except for a highest grayscale, the waveforms representing the same grayscale of the first PWM manner and the second PWM manner fall at different times in the period.

9. The method of claim 6, wherein the organic light emitting diodes are electrically connected to a plurality of segment lines and a plurality of common lines in a matrix structure, the organic light emitting diodes electrically connected to one half of the segment lines are defined as the first group, and the organic light emitting diodes electrically connected to the other half of the segment lines are defined as the second group.

10. The method of claim 6, wherein the period is a refresh period of the OLED panel.

11. An organic light emitting display (OLED), comprising:

a plurality of segment lines;

a plurality of common lines;

a plurality of organic light emitting diodes, electrically connected to the segment lines and the common lines in a matrix structure, wherein the organic light emitting diodes of one common line are divided into a first group and a second group; and a segment driver, electrically connected to the segment lines and arranged to supply driving currents to the organic light emitting diodes of the first group and the second group separately according to a first pulse width modulation (PWM) manner and a second PWM manner, wherein the first PWM manner and the second PWM manner have complementary waveforms in a period, and except for a highest grayscale, the segment driver is arranged to raise the waveforms representing the same grayscale of the first PWM manner and the second PWM manner at different times in the period.

12. The OLED of claim 11, wherein from a lowest grayscale to a highest grayscale, the segment driver is arranged to increase the waveforms of the first PWM manner in length by measuring from a starting time of the period and to increase the waveforms of the second PWM manner in length by measuring from an ending time of the period.

13. The OLED of claim 11, wherein except for a highest grayscale, the segment driver is arranged to lower the waveforms representing the same grayscale of the first PWM manner and the second PWM manner at different times in the period.

14. The OLED of claim 11, wherein the organic light emitting diodes electrically connected to one half of the segment lines are defined as the first group, and the organic light emitting diodes electrically connected to the other half of the segment lines are defined as the second group.

15. The OLED of claim 11, wherein the period is a refresh period of the OLED panel.

* * * * *